US006865904B2

(12) United States Patent
Wang

(10) Patent No.: US 6,865,904 B2
(45) Date of Patent: Mar. 15, 2005

(54) COMBINED REGENERATION HEATING AND COOLING SYSTEM

(75) Inventor: Hwa-Sik Wang, Ojung-gu (KR)

(73) Assignee: Tempia Co., Ltd., Chungcheongnam-do (KR)

( * ) Notice: Subject to any disclaimer, the term of this patent is extended or adjusted under 35 U.S.C. 154(b) by 0 days.

(21) Appl. No.: 10/720,108

(22) Filed: Nov. 25, 2003

(65) Prior Publication Data

US 2004/0159117 A1 Aug. 19, 2004

(30) Foreign Application Priority Data

Nov. 25, 2002 (KR) ..... 10-2002-73656
Sep. 26, 2003 (KR) ..... 10-2003-67369

(51) Int. Cl.[7] ..... F25B 13/00
(52) U.S. Cl. ..... 62/324.1; 32/513
(58) Field of Search ..... 62/324.1, 113, 62/513

(56) References Cited

U.S. PATENT DOCUMENTS 4,196,595 A * 4/1980 Shaw ..... 62/160
4,488,413 A * 12/1984 Bottum ..... 62/503
5,218,844 A * 6/1993 Nishiguchi et al. ..... 62/476
6,463,757 B1 * 10/2002 Dickson et al. ..... 62/503
6,584,796 B2 * 7/2003 Itoh et al. ..... 62/324.1
6,604,376 B1 * 8/2003 Demarco et al. ..... 62/324.1
6,644,059 B2 * 11/2003 Maeda et al. ..... 62/271
6,668,569 B1 * 12/2003 Jin ..... 62/197
6,672,082 B1 * 1/2004 Maeda et al. ..... 62/93
6,679,321 B2 * 1/2004 Jin ..... 165/236
6,708,513 B2 * 3/2004 Koehler et al. ..... 62/244
6,755,043 B2 * 6/2004 Jensen et al. ..... 62/268
6,755,046 B2 * 6/2004 Nishida et al. ..... 62/324.1

FOREIGN PATENT DOCUMENTS

JP 405280813 a * 10/1993
JP 406002966 A * 1/1994
JP 406088649 A * 3/1994

* cited by examiner

*Primary Examiner*—William E. Tapolcai
*Assistant Examiner*—Mohammad M. Ali
(74) *Attorney, Agent, or Firm*—Millen, White, Zelano & Branigan

(57) ABSTRACT

The present invention relates to a combined regeneration cooling and heating system capable of enhancing a heat exchange efficiency based on a heat exchange between a high temperature refrigerant flowing in the interior of an expansion unit and a low temperature refrigerant flowing in the outside. A compressor for compressing refrigerant to a high temperature and pressure state, an indoor unit installed in the indoor for cooling an indoor air by heat-exchanging a low temperature expanded refrigerant with an indoor air in the cooling mode and for heating an indoor air by heat-exchanging a high temperature and pressure refrigerant with an indoor air in the heating mode, an outdoor unit installed in the outdoor for discharging heat into the air by heat-exchanging a high temperature and pressure refrigerant with an external air in the cooling mode and for heating a refrigerant by heat-exchanging the expanded refrigerant with an external air in the heating mode, and a heat exchange unit in which a heat exchanger in which a high temperature refrigerant discharged from the indoor unit flows and the expansion unit adapted to receive a refrigerant of the heat exchanger and to expand the same.

9 Claims, 10 Drawing Sheets

COMBINED REGENERATION HEATING AND COOLING SYSTEM

BACKGROUND OF THE INVENTION

1. Field of the Invention

The present invention relates to a combined regeneration heating and cooling system, and in particular to a combined regeneration heating and cooling system that is capable of implementing a high heat exchange efficiency in such a manner that a heat exchange unit capable of heat-exchanging a high temperature refrigerant from an indoor unit during a heating mode and a low temperature refrigerant from an outdoor unit and an expansion unit in which a refrigerant passed through the heat exchanger is expanded are installed in the interior of one heating exchanging unit, so that a high temperature refrigerant flowing in the interior of an expansion unit and a low temperature refrigerant are heat-exchanged.

2. Description of the Background Art

A heating and cooling apparatus combined with a cooling apparatus and heating apparatus is generated, so that an indoor temperature is decreased in home, office, factory, etc. in the summer season by cooling temperature, and an indoor temperature is increased in the winter season for thereby implementing a comfortable indoor environment.

The above heating and cooling apparatus is generally implemented by a method for heating by burning light oil or gas and an electric coil method using an electric heater.

However, in the former case, there is a problem that oxygen may be lacked in the air due to a method of burning indoor oxygen, and in the latter case, there is a problem that power is over consumed because it uses power.

As shown in FIG. 1, in order to overcome the above problems, a cooling and heating system implemented using refrigerant is disclosed. The above cooling and heating system includes an indoor unit 103 installed in the indoor, an outdoor unit 109 installed in the outdoor, a compressor 101 for compressing and discharging refrigerant, an expansion unit 105, 107 for changing refrigerant to a low temperature before the refrigerant is supplied to the indoor unit 103 or the outdoor unit 109, and a plurality of valves 111 and 113 for controlling the flow of the refrigerant.

Here, the heating and cooling system 103 is adapted to cool the indoor air based on a heat exchange with the refrigerant inputted in the cooling mode, and to heat the indoor air by condensing the refrigerant based on the heat exchange with the refrigerant inputted in the heating mode. The outdoor unit 109 is adapted to cool the refrigerant inputted based on the heat exchange with the outdoor air in the cooling mode and to heat the refrigerant inputted based on the heat exchange with the outdoor air in the heating mode. The expansion unit 105, 107 is adapted to expand the refrigerant inputted into the outdoor unit 109 in the heating mode for thereby cooling the refrigerant to be lower than the outdoor air and to expand the refrigerant inputted into the indoor unit 103 in the cooling mode for thereby cooling to the low temperature lower than the indoor air.

In the above-described conventional cooling and heating system, since the low temperature refrigerant from the outdoor unit in the heating mode is directly flown into the compressor, a large amount of calorie is needed for compressing a high temperature and pressure in the compressor, and a large mechanical problem in durability.

In addition, in the above conventional heating and cooling system, in the case that there is a large temperature difference between the outdoor temperature in the heating mode and the temperature of the refrigerant flown into the outdoor unit, frost may be formed in the outdoor unit, so that it is impossible to obtain a desired external heat, and a frost formation problem may occur.

SUMMARY OF THE INVENTION

Accordingly, it is an object of the present invention to provide a combined regeneration heating and cooling system that overcomes the problems countered in the conventional art.

It is another object of the present invention to provide a combined regeneration heating and cooling system that is capable of implementing a high heat exchange efficiency in such a manner that a heat exchange unit capable of heat-exchanging a high temperature refrigerant from an indoor unit during a heating mode and a low temperature refrigerant from an outdoor unit and an expansion unit in which a refrigerant passed through the heat exchanger is expanded are installed in the interior of one heating exchanging unit, so that a high temperature refrigerant flowing in the interior of an expansion unit and a low temperature refrigerant are heat-exchanged.

It is further another embodiment of the present invention to provide a combined regeneration cooling and heating system that is capable of simplifying the construction of a facility of a heat exchange by installing a heat exchange unit and an expansion unit in the interior of a heat exchange unit together.

It is still further embodiment of the present invention to provide a combined regeneration cooling and heating system that is capable of preventing a frost formation in an outdoor unit by decreasing a temperature difference between a temperature of a refrigerant flown into an outdoor unit and a temperature of an outdoor air in such a manner that a heat exchange between a refrigerant supplied to the outdoor and a refrigerant discharged from the outdoor unit is performed by a heat exchange in which a heat exchange is performed without any variation in pressure.

It is still further another embodiment of the present invention to provided a combined regeneration cooling and heating system that is capable of mixing a high temperature refrigerant heat-exchanged in a heat exchange unit in a heating mode with a low temperature refrigerant before a heat exchange is performed and increasing a low temperature inputting refrigerant of a compressor for thereby implementing an efficient operation of the compressor.

To achieve the above objects, in a cooling and heating system including a compressor for compressing refrigerant to a high temperature and pressure state, an indoor unit installed in the indoor for cooling an indoor air by heat-exchanging a low temperature expanded refrigerant with an indoor air in the cooling mode and for heating an indoor air by heat-exchanging a high temperature and pressure refrigerant with an indoor air in the heating mode, an outdoor unit installed in the outdoor for discharging heat into the air by heat-exchanging a high temperature and pressure refrigerant with an external air in the cooling mode and for heating a refrigerant by heat-exchanging the expanded refrigerant with an external air in the heating mode, and a heat exchange unit for heat-exchanging a high temperature refrigerant from the indoor unit with a low temperature refrigerant from the outdoor unit in the heating mode, there is provided a combined regeneration cooling and heating system that is characterized in that a heat exchanger capable of heat-exchanging a high temperature refrigerant from the indoor unit with a refrigerant inputted into the outdoor unit, and an expansion unit adapted to receive a refrigerant of the heat exchanger and to expand for cooling the refrigerant are installed in the interior of the heat exchange unit; and a high temperature refrigerant from the indoor unit and a low temperature refrigerant from the outdoor unit are inputted into the heat exchange unit in the heating mode, and the high temperature refrigerant flows through the heat exchanger and the expansion unit and is heat-exchanged with the low temperature refrigerant.

Preferably, there is further provided a refrigerant supply line for preventing a frost formation in an outdoor unit in the heating mode and for directly supplying the refrigerant from the indoor unit to the outdoor unit without through the heat exchange unit.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

The preferred embodiments of the present invention will be described with reference to the accompanying drawings.

Figure 1:
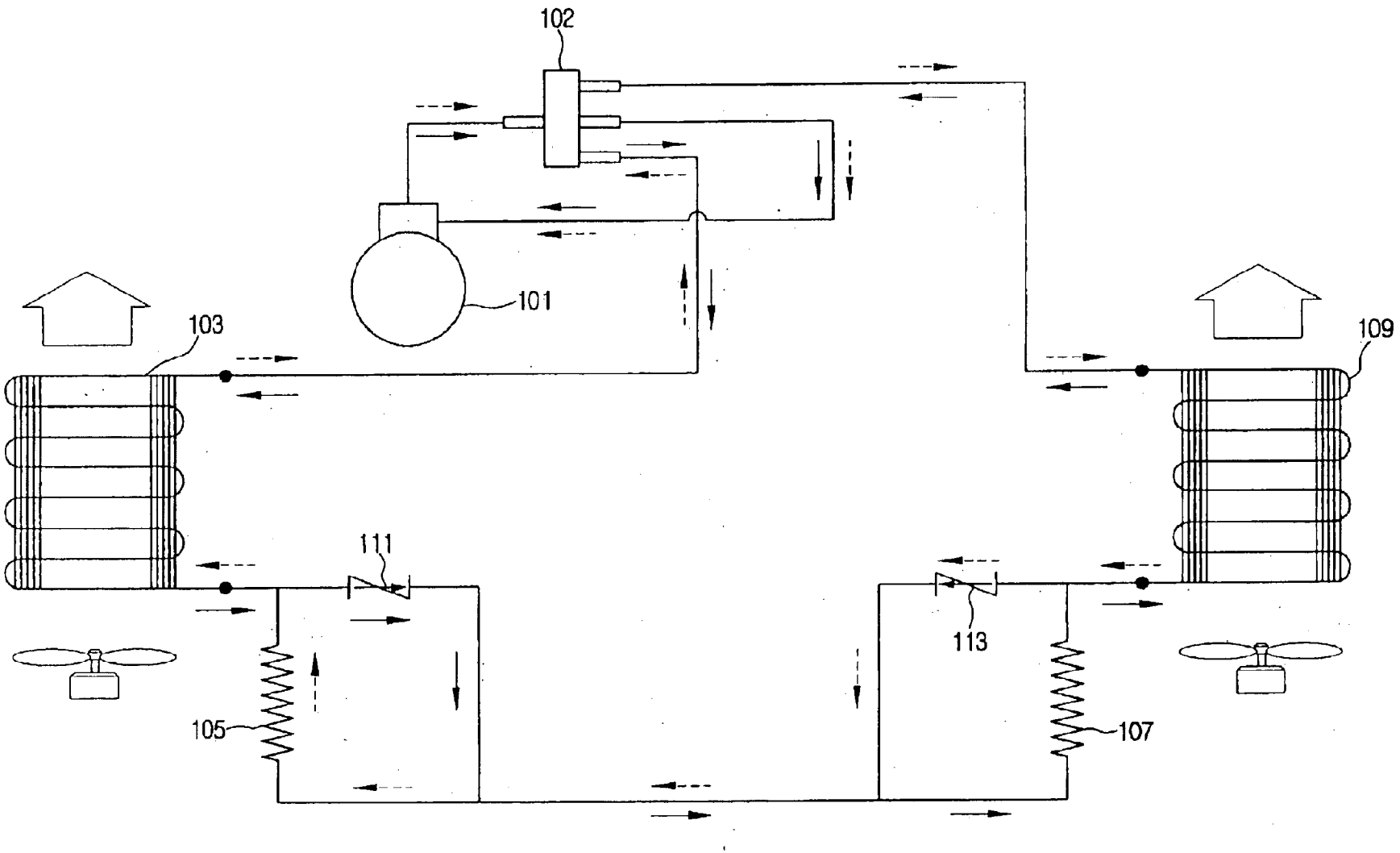
FIG. 1 is a view illustrating the construction of a conventional heating and cooling system.
Figure 2:
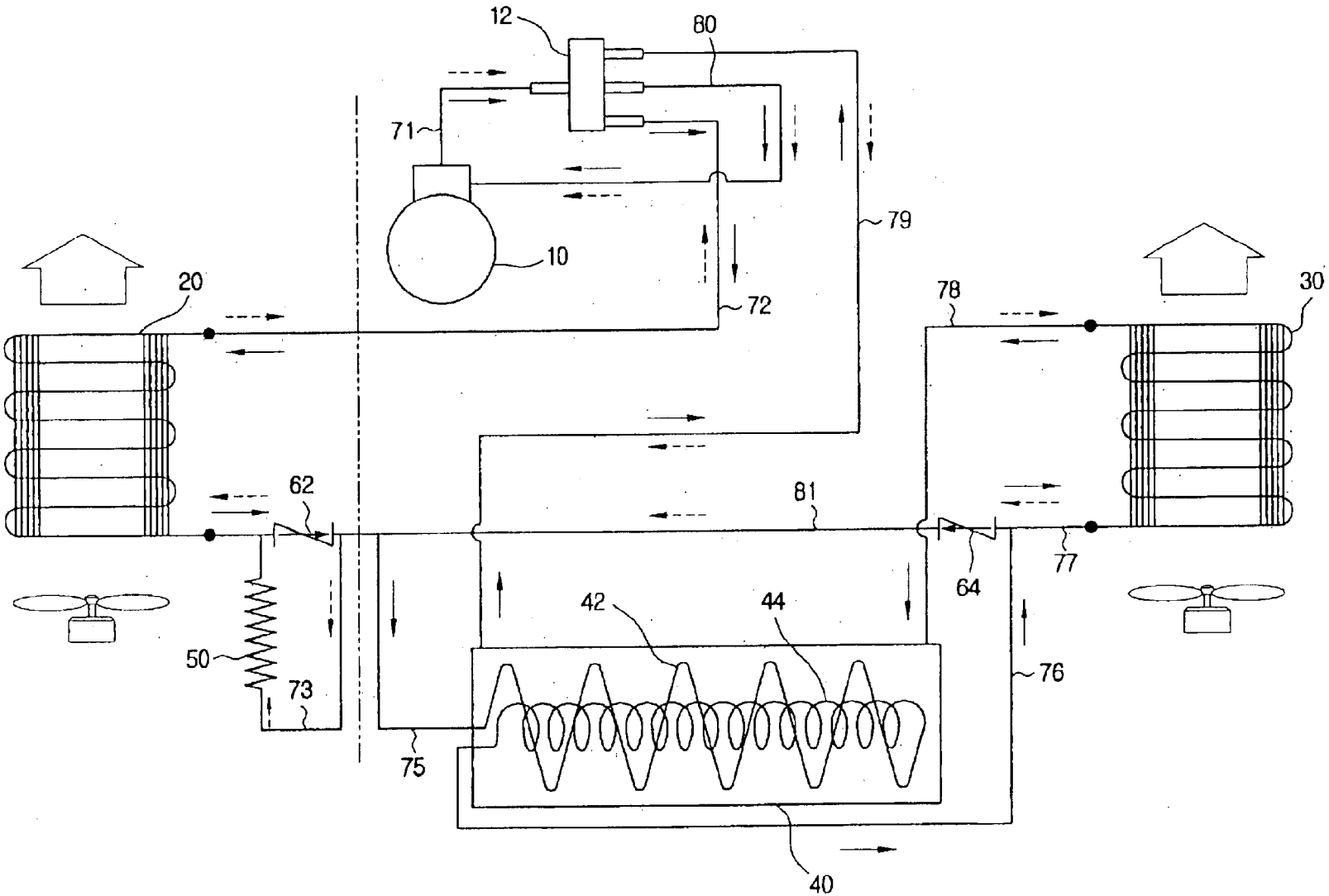
FIG. 2 is a view illustrating the construction of a combined regeneration heating and cooling system according to an embodiment of the present invention.
Figure 3:
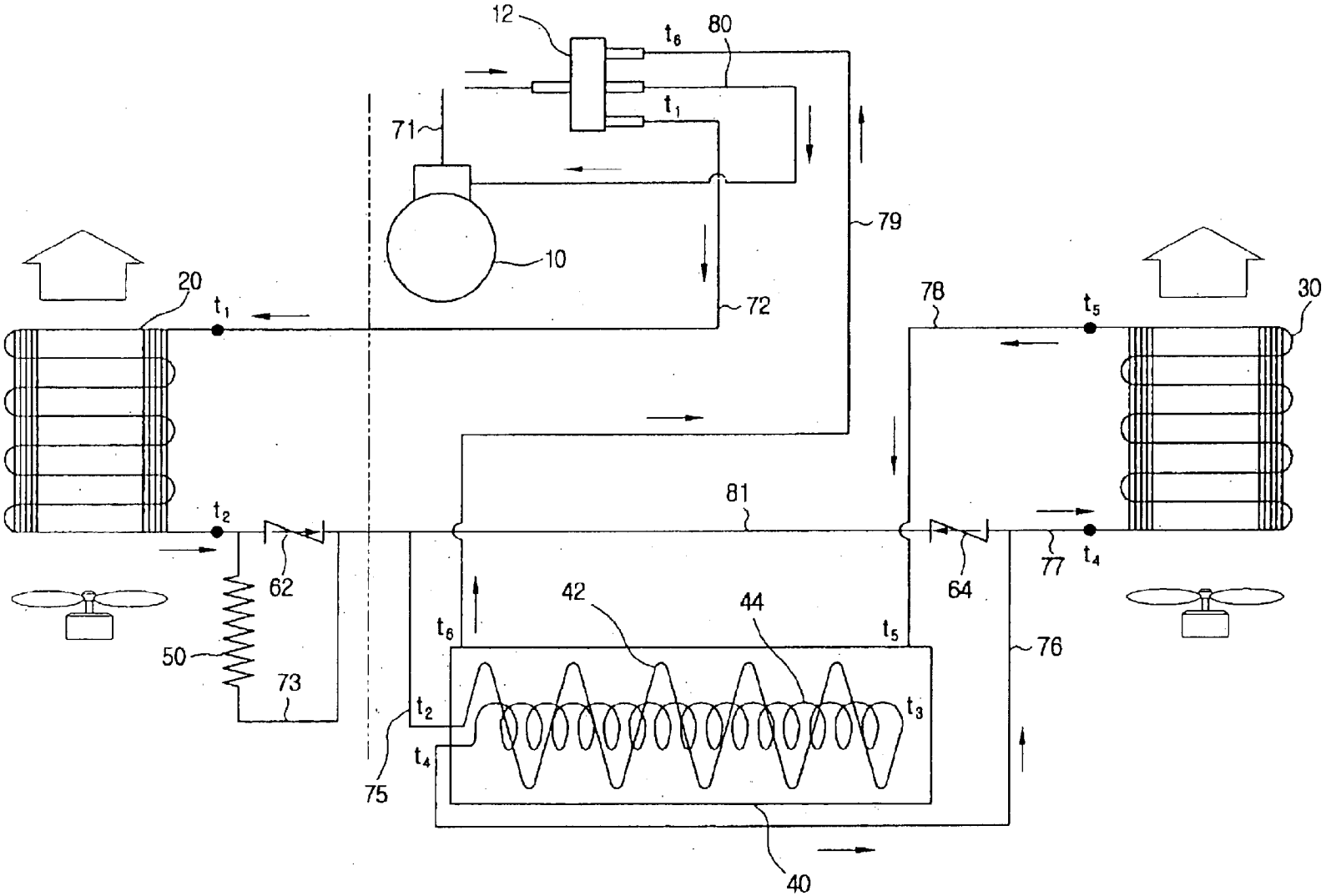
FIG. 3 is a view illustrating a heating operation mode in a combined regeneration heating and cooling system according to an embodiment of the present invention.
Figure 4:
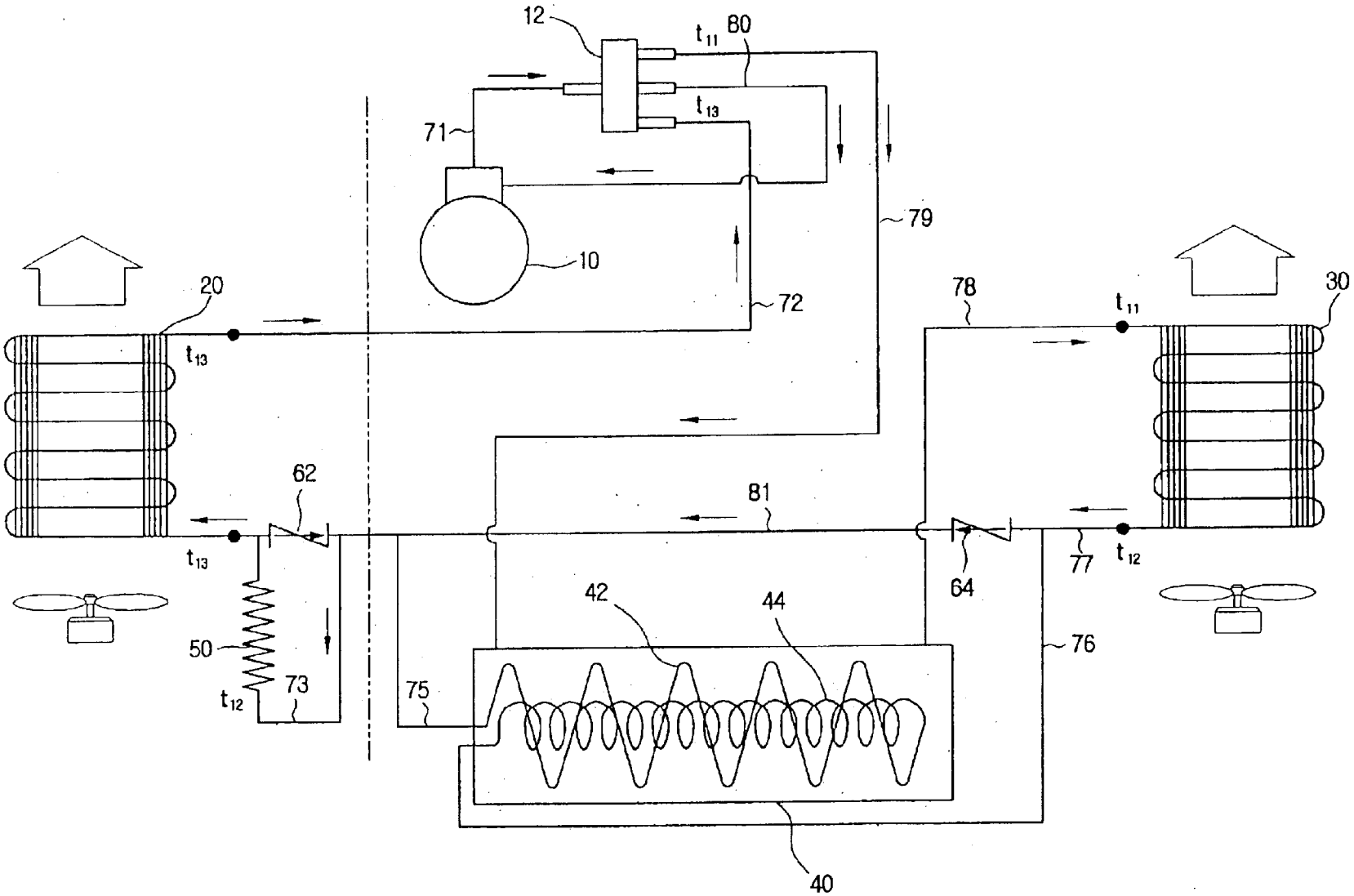
FIG. 4 is a view illustrating a cooling operation mode in a combined regeneration heating and cooling system according to an embodiment of the present invention.

FIG. 2 is a view illustrating the construction of a combined regeneration heating and cooling system according to an embodiment of the present invention, FIG. 3 is a view illustrating a heating operation mode in a combined regeneration heating and cooling system according to an embodiment of the present invention, and FIG. 4 is a view illustrating a cooling operation mode in a combined regeneration heating and cooling system according to an embodiment of the present invention.

As shown in FIG. 2, the combined regeneration cooling and heating system according to the present invention includes a compressor 10 for compressing a high temperature and pressure, an indoor unit 20 installed in the indoor for cooling an indoor air by heat-exchanging a low temperature expanded refrigerant inputted in the cooling mode with an indoor air and heating an indoor air by heat-exchanging a high temperature and pressure refrigerant inputted in the heating mode with an indoor air, an outdoor unit 30 installed in the outdoor for discharging heat to the outside by heat-exchanging a high temperature and pressure refrigerant inputted in the cooling mode with an outdoor air and heating a refrigerant by heat-exchanging the expanded refrigerant inputted in the cooling mode with an outdoor air, a heat exchange unit 40 for heat-exchanging a high temperature refrigerant inputted into the outdoor unit 30 in the heating mode and a low temperature refrigerant discharged from the outdoor unit 30 and inputted into the compressor 10, and an expansion unit 50 for expanding a refrigerant inputted into the indoor unit 20 in the cooling mode to a low temperature refrigerant.

In the interior of the heat exchange unit 40, there are provided a heat exchanger 42 in which a high temperature refrigerant from the indoor unit 20 flows for thereby heat-exchanged with a low temperature refrigerant inputted from the outdoor unit 30, and an expansion unit 44 adapted to receive a refrigerant from the heat exchanger 42 for thereby expanding to a much lower temperature. Therefore, the refrigerant inputted from the indoor unit and passed through the heat exchanger is heat-exchanged with a low temperature refrigerant inputted from the outdoor unit 30, and the temperature of the same is decreased. The refrigerant is expanded by the expansion unit 44, and the temperature of the same is decreased to a lower temperature. In particular, since the expansion unit 44 is installed in the interior of the heat exchange unit 40, a heat exchange is performed with a low temperature refrigerant, and the refrigerant is expanded and has a lower temperature. The heat exchanger 42 is formed of a double capillary tube, so that a refrigerant flows based on its pressure difference for thereby implementing a heat exchange.

As shown in FIG. 3, the heating operation using a combined regeneration cooling and heating system according to the present invention will be described.

When a user selects a heating mode, a high temperature an pressure refrigerant having a temperature of t1 is compressed by the compressor 10 and is inputted into the indoor unit 20 through a 4-direction valve 12 and is heat-exchanged with the indoor air by the indoor unit 20 and increases the temperature of the indoor air. The refrigerant is first condensed and has a lowered temperature t2 (t1>t2).

The refrigerant condensed to a temperature t2 flows through a first check valve 62 and a pipe line 75 and is second condensed while passing through the heat exchanger 42 of the heat exchange unit 40. The refrigerant is expanded to a low temperature while passing through the expansion unit 44 and becomes a moisture vapor state of a low temperature having a temperature t4 lower than the outdoor air (t2>t4, outdoor air>t4: here, the heat exchange of the refrigerant being heat-exchanged by the heat exchange unit and having a temperature range of t2 through t4 will be described later).

The moisture vapor state refrigerant passed through the heat exchange unit 40 and having a temperature of t4 is supplied to the outdoor unit 30 through the pipe line 76, 77 and is heat-exchanged with an outdoor air by the outdoor unit 30 for thereby absorbing an external temperature and being first-evaporated at a temperature t5.

The refrigerant heated by the outdoor unit 30 and having a temperature t5 passes through the heat exchange unit 40 through the pipe line 78 and is heat-exchanged with the refrigerant of the heat exchanger 42 inputted with a temperature t2 and the refrigerant of the expansion unit 44 inputted with a temperature t3 for thereby being second-evaporated at a temperature t6 (t5<t6). Namely, the refrigerant flowing in the direction of the compressor 10 is heated to a temperature t6, and the refrigerant flowing in the direction of the outdoor unit 30 is cooled to a temperature t3 through the compressor 42 and is cooled to a temperature t4 through the expansion unit 44. In addition, the refrigerant passing through the expansion unit 44 is heat-exchanged with the refrigerant inputted from the outdoor unit 30 before it is expanded by the expansion unit 44, so that the refrigerant is expanded to a much lower temperature.

Finally, the refrigerant second evaporated by the heat exchange unit 40 and having a temperature t6 is supplied to the compressor 10 through the pipe line 79 and the 4-direction valve 12 and is compressed and has a high temperature and pressure and is changed to a refrigerant having a temperature t1 (t6<t1).

Since the refrigerant of a high temperature is inputted into the compressor 10 through the above-described procedure, it is possible to significantly decrease the calorie needed for compressing the refrigerant to a high temperature and pressure. In addition, since the heat exchange expansion is continuously performed by one heat exchange unit 40, a heat exchange efficiency is high, and it is possible to easily install.

As shown in FIG. 4, when a user selects a cooling mode, a high temperature and pressure refrigerant compressed by the compressor 10 and having a temperature t1 is supplied to the outdoor unit 30 through the 4-direction valve 12, the pipe line 79 and the heat exchange unit 40 and is heat-exchanged with an outdoor air by the outdoor unit 30 and is condensed to a temperature t12 (t11>t12). At this time, since the refrigerant directly passes through the pipeline 79 and the heat exchange unit 40, the refrigerant is directly moved to the outdoor unit 30 without any heat exchange.

The refrigerant heat-exchanged with an outdoor air by the outdoor unit 30 and having a temperature t12 is supplied to the expansion unit 50 through a second check valve 64 and the pipe line 81 and is expanded while passing through the expansion unit 50 and is changed to a low temperature and pressure moisture vapor state having a temperature t13 (t12>t13).

The refrigerant cooled to a temperature t13 is flown into the indoor unit 20 for thereby cooling the temperature of the indoor air through a heat exchange with the indoor air, and the refrigerant is evaporated at a temperature t14 (t13<t14).

The refrigerant heated to a temperature t14 by the indoor unit 20 is flown into the compressor 10 through the pipeline 72 and the 4-direction valve 12 and is compressed to a high temperature and pressure.

At this time, the calorie heat-exchanged by the indoor unit 20 or the outdoor unit 30 may be expressed in the following Equation 1.

Figure 5:
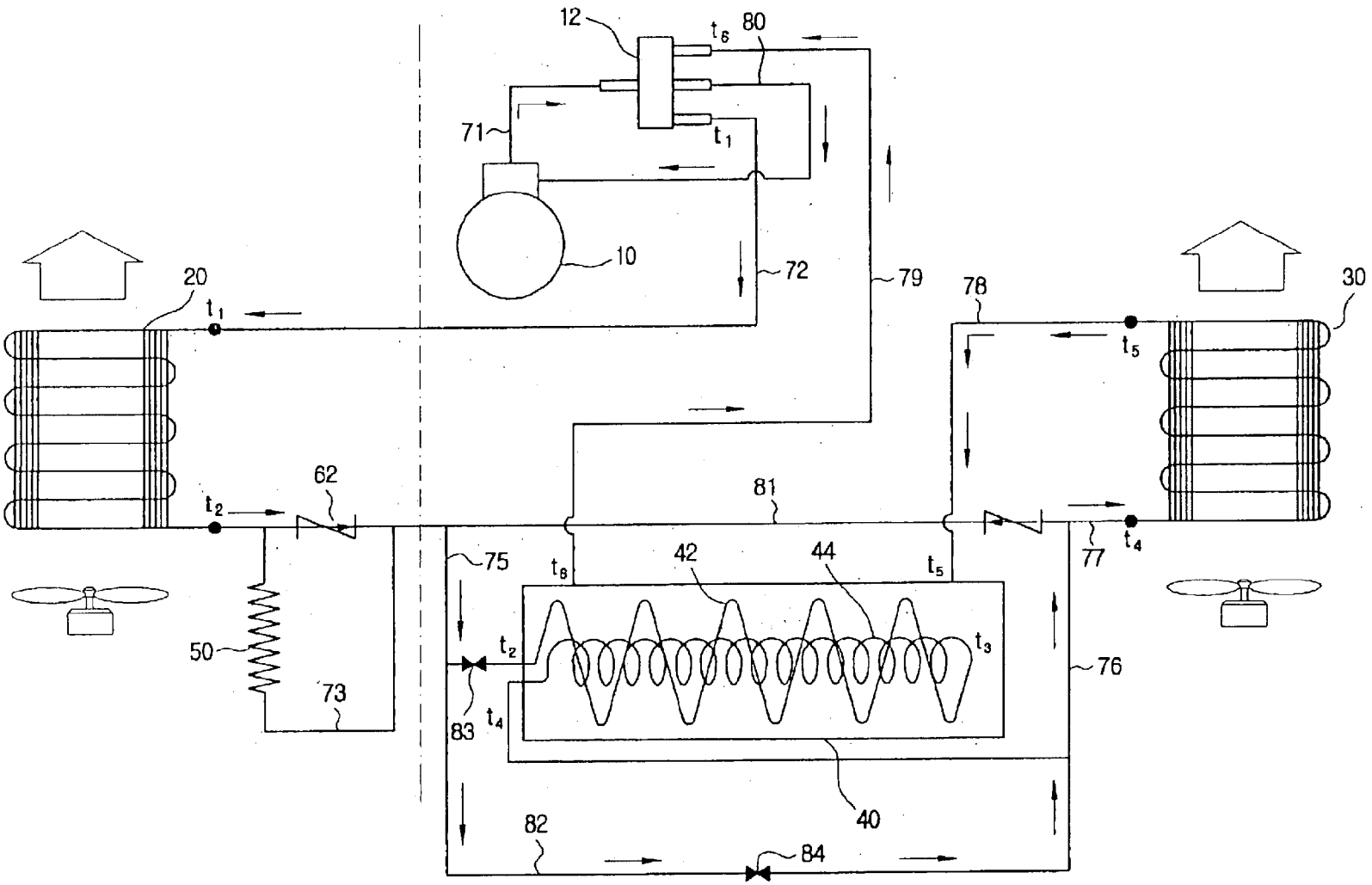
FIGS. 5 through 9B are views illustrating a combined regeneration cooling and heating system according to another embodiment of the present invention.

Equation 1

$$xQ=mc(t_1-t_2)$$

where, xQ: calorie supplied to indoor air and outdoor air m: amount of refrigerant flowing per unit hour c: specific heat of refrigerant $t_1$: temperature of refrigerant inputted $t_2$: temperature of refrigerant outputted As shown in FIG. 5, in the combined regeneration cooling and heating system according to another embodiment of the present invention, in the case that a difference between the temperature of the outdoor air and the temperature of the refrigerant supplied to the outdoor unit 30 is large (above 5° C. below zero) due to a certain outdoor weather condition (for example, mixed snow and snow sleet, heavy snow, etc.), front is formed in the outdoor unit 30.

In order to remove the front formed in the outdoor unit 30, a first refrigerant supply line 82 is further installed for supplying a high temperature refrigerant discharged from the outdoor unit 20 to the outdoor unit 30 and controlling the refrigerant. In addition, a first sol valve 83 is installed in front of the heat exchange unit 40 for adjusting the amount of refrigerant inputted into the heat exchange unit 40. A second sol valve 84 is installed in one side of the first refrigerant supply line 82 for adjusting the amount of refrigerant discharged to the outdoor unit 30.

Therefore, when the first sol valve 83 is closed, and the second sol valve 84 is opened, a high temperature refrigerant having a temperature t2 is directly inputted into the outdoor unit 30 through the first refrigerant supply line 82, so that it is possible to remove frost formed in the outdoor unit 30.

At the usual time, the second sol valve 84 capable of controlling refrigerant discharged through the first refrigerant supply line 82 is opened, and the refrigerant discharged from the indoor unit 20 is moved through the heat exchange unit 40.

Figure 6:
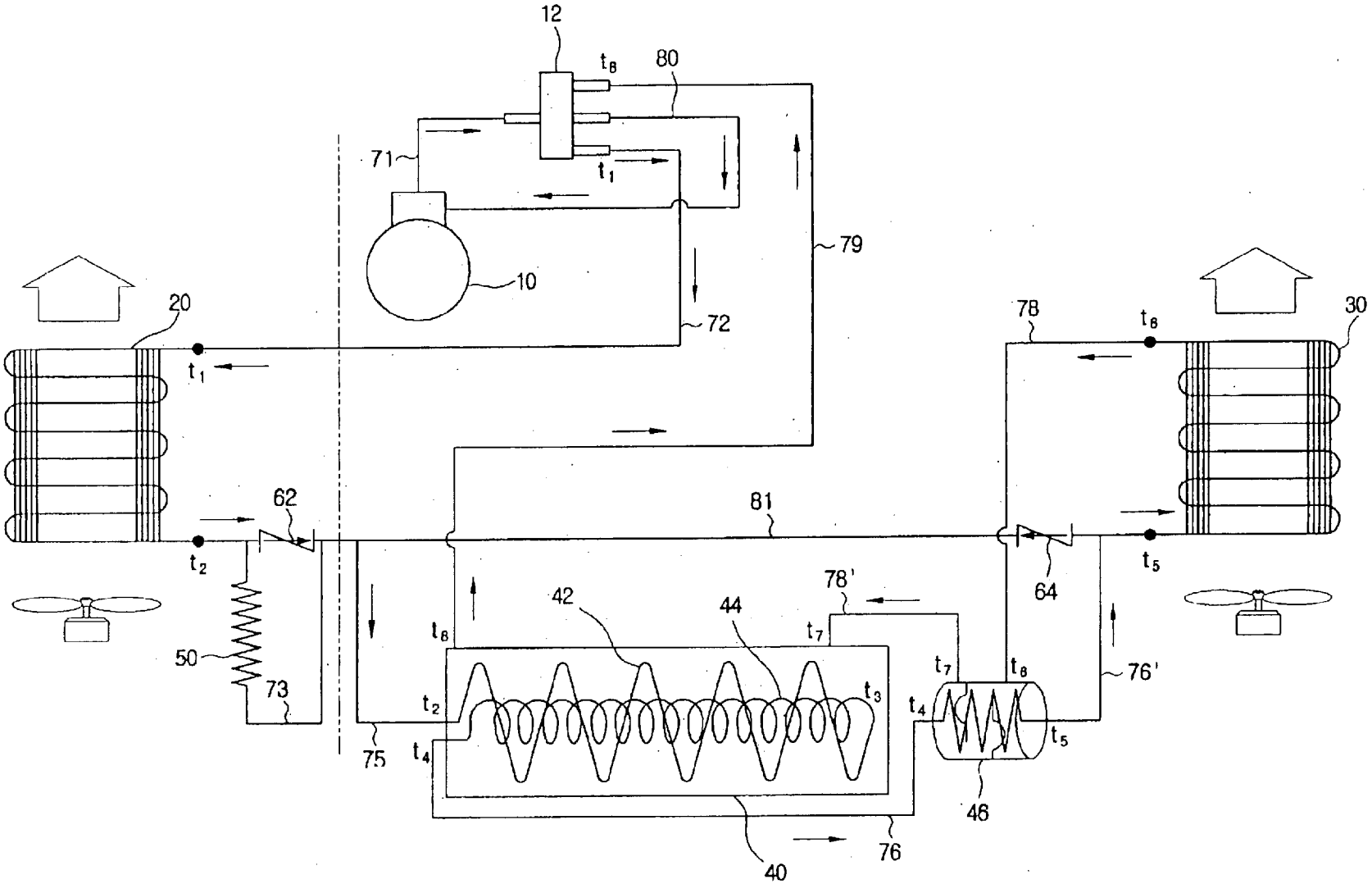

As shown in FIG. 6, in the combined regeneration cooling and heating system according to further another embodiment of the present invention, it is possible to previously prevent the phenomenon that frost is formed in the outdoor 30.

In order to prevent frost from being formed in the outdoor unit 30, a second heat exchanger 46 is further installed between the heat exchange unit 40 and the outdoor unit 30 for heat-exchanging the temperature of the refrigerant from the heat exchange unit 40 with the refrigerant discharged from the outdoor unit 30. At this time, the second heat exchanger 46 is formed of a heat exchanger designed to implement only a heat exchange without generating pressure.

Therefore, in the second heat exchanger 46, the heat exchange is performed until a temperature difference between the low temperature refrigerant from the outdoor unit 30 and the refrigerant from the heat exchange unit 40 becomes a temperature (below about 5° C. below zero) of a range in which the frost is not formed. Thereafter, the refrigerant is supplied to the outdoor 30 for thereby basically preventing the frost in the outdoor unit 30.

Figure 7:
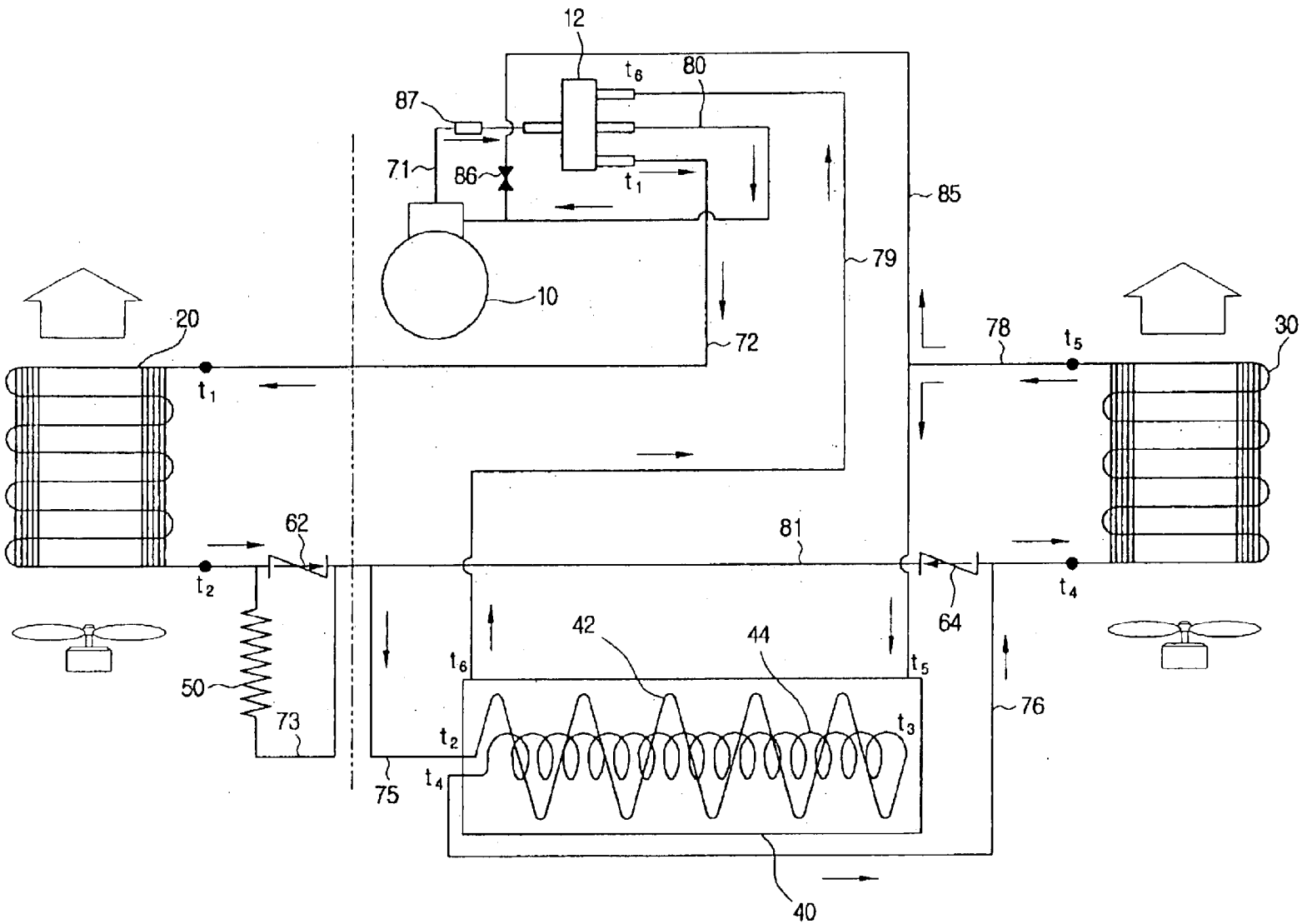

As shown in FIG. 7, in the combined regeneration cooling and heating system according to further another embodiment of the present invention, the compressor 10 compresses the refrigerant and makes it have a certain high pressure for thereby preventing the compressor 10 from being damaged.

In the case that the refrigerant inputted into the compressor 10 is above a certain temperature (that represents a temperature lower by about 5° C. compared to the limit temperature at which the normal operation of the compressor 1 is stopped due to the refrigerant compressed to an abnormal high temperature used in the cooling and heating system. The common compressor 19 stops when the limit temperature of the refrigerant compressed by and outputted from the compressor 10 is about 130° C. Therefore, the above certain temperature represents about 125° C.) There are further provided a temperature sensor 87 for checking and comparing the temperature of the refrigerant from the compressor, and a refrigerant adjusting valve 86 for controlling a low temperature refrigerant to be supplied to the compressor 10 through the second refrigerant supply line 85 in accordance with a temperature sensor signal in the case that the temperature of the checked refrigerant is out of the previously set temperature range.

The temperature sensor 87 detects the temperature of the refrigerant compressed by and discharged from the compressor 10 and compares the detected temperature with the previously set temperature range (here, the previously set temperature range represents a range capable of preventing the compressor from being stopped and capable of maintaining a high temperature and pressure, and the set temperature is preferably about 125 C. through 100 C. in the case that the limit temperature of the compressor is 130 C.). In the case that the temperature of the refrigerant is higher than the temperature range, the refrigerant adjusting valve 86 is opened, and the low temperature refrigerant discharged from the outdoor unit 30 through the second refrigerant supply line 85 is supplied to the pipe line 80 connected with the compressor, so that the temperature of the refrigerant inputted into the compressor 10 is decreased.

In the case that the temperature of the refrigerant discharged from the compressor 10 is lower than the previously set temperature range, the refrigerant adjusting valve 86 is closed, and the refrigerant discharged from the outdoor unit 30 is prevented from being inputted into the pipe line 85, and the refrigerant heat-exchanged by the heat exchanger 40 is inputted into the compressor 10.

Figure 8:
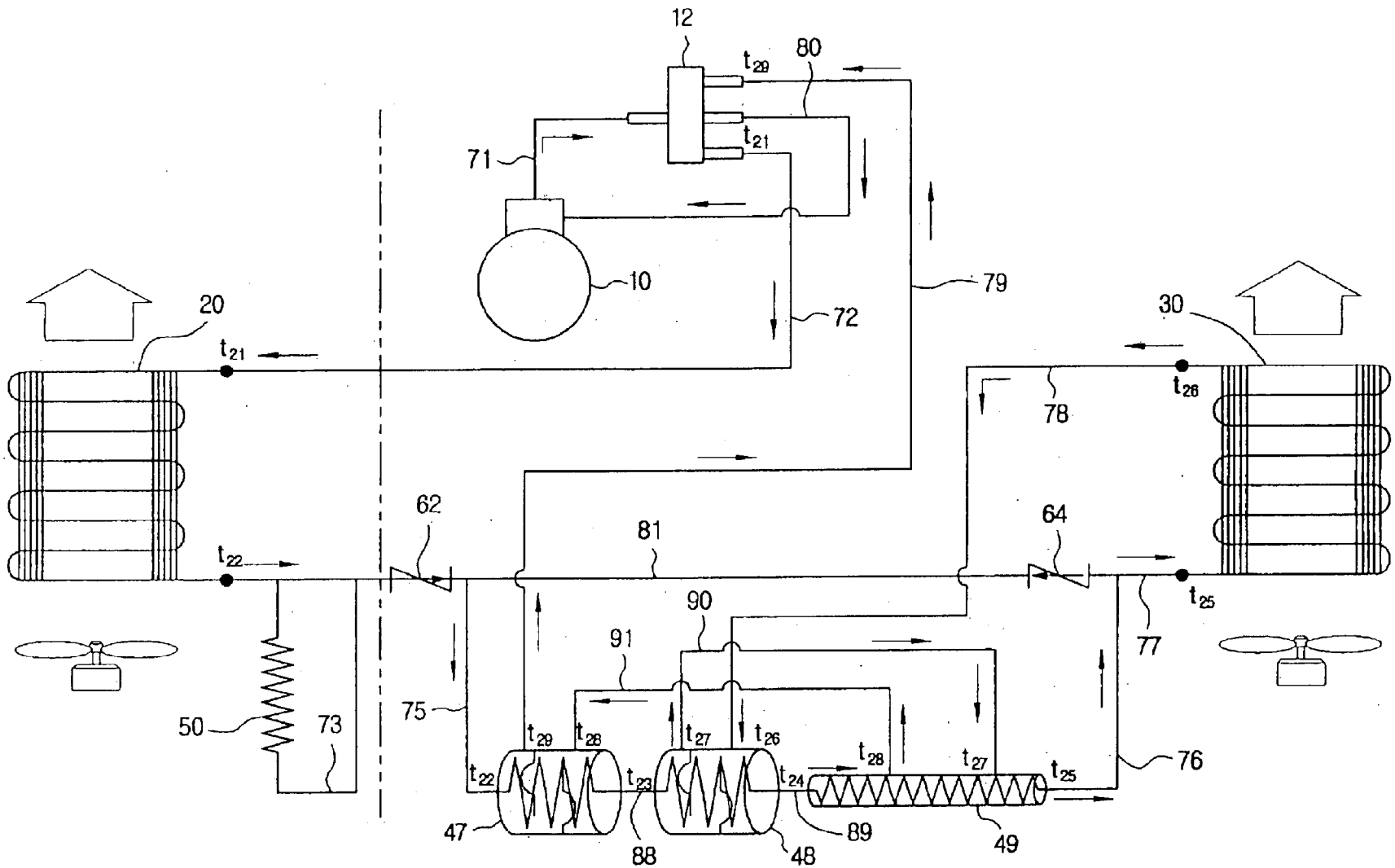

As shown in FIG. 8, in the combined regeneration cooling and heating system according to further another embodiment of the present invention, the heat exchange unit 40 includes a first heat exchanger 47, a second heat exchanger 48 and an expansion unit 49.

When the user selects a heating model, in the indoor unit 20, the refrigerant having an input temperature t21 and first-condensed with a temperature t22 is second-condensed by the first heat exchanger 47 through the first check valve 62 and the pipe line 75, and the temperature of the same is decreased to a temperature t23. The refrigerant passed through the first heat exchanger 47 is third-condensed while passing through the second heat exchanger 48, and the temperature of the same is decreased to a temperature t24. The refrigerant passed through the second heat exchanger 48 is fourth-condensed while passing through the expansion unit 49, and the refrigerant is more expanded and is changed to a low temperature moisture vapor state having a temperature t25 lower than the outdoor air (t23>t24>t25, outdoor air>t25).

Thereafter, the refrigerant of a moisture vapor state having a temperature t25 and passed through the expansion unit 49 is supplied to the outdoor unit 30 through the pipeline 76, 77 and absorbs an external heat based on heat exchange with the outdoor air in the outdoor unit 30. The refrigerant itself is first evaporated at a temperature t26 (t25<t26<outdoor temperature).

The refrigerant heated by the outdoor unit 30 to a temperature t26 is heat-exchanged with a high temperature refrigerant having a temperature t23, while passing through the second heat exchanger 48 and is second evaporated at a temperature t27 (t26<t27). The refrigerant flowing in the direction of the compressor 10 is heated to a temperature t27, and the refrigerant flowing in the direction of the outdoor unit 30 is cooled to a temperature t24. At this time, it is preferred that the refrigerant heated to a temperature t27 is evaporated based on a full vaporization method.

Thereafter, the refrigerant having a temperature t27 passed through the second heat exchanger 48 is heat-exchanged with a high temperature refrigerant inputted at a temperature t24, while passing through the expansion unit 49 and is third vaporized at a temperature t28 (t27<t28). Namely, the refrigerant flowing in the direction of the compressor 10 is heated to a temperature t28, and the refrigerant flowing in the direction of the outdoor unit 30 is cooled to a temperature t25. At this time, the third vaporized refrigerant is adapted to decrease a temperature difference between the outlet side temperature of the expansion unit 49 and the outdoor temperature. Therefore, it is possible to prevent a frost formation caused due to a decrease of the outdoor temperature in the winter season, and a heat exchange with the outdoor air is easily implemented.

The refrigerant third-vaporized by the expansion unit 49 and having a temperature t28 is heat-exchanged with a high temperature refrigerant having a temperature t22 while passing through the first heat exchanger 47 and is fourth-vaporized at a temperature t29 (t28<t29). Namely, the refrigerant flowing in the direction of the compressor 10 is heated to a temperature t29, and the refrigerant flowing in the direction of the outdoor unit 30 is decreased to a temperature t23.

Finally, the refrigerant heated to a temperature t29 by the first heat exchanger 47 is supplied to the compressor 10 and is compressed and has a high temperature and pressure and is changed to a refrigerant having a temperature t21.

Therefore, since a high temperature refrigerant is inputted into the compressor 10, it is possible to significantly decrease calorie needed for compressing the inputted refrigerant to a high temperature and pressure refrigerant.

Figure 9A:
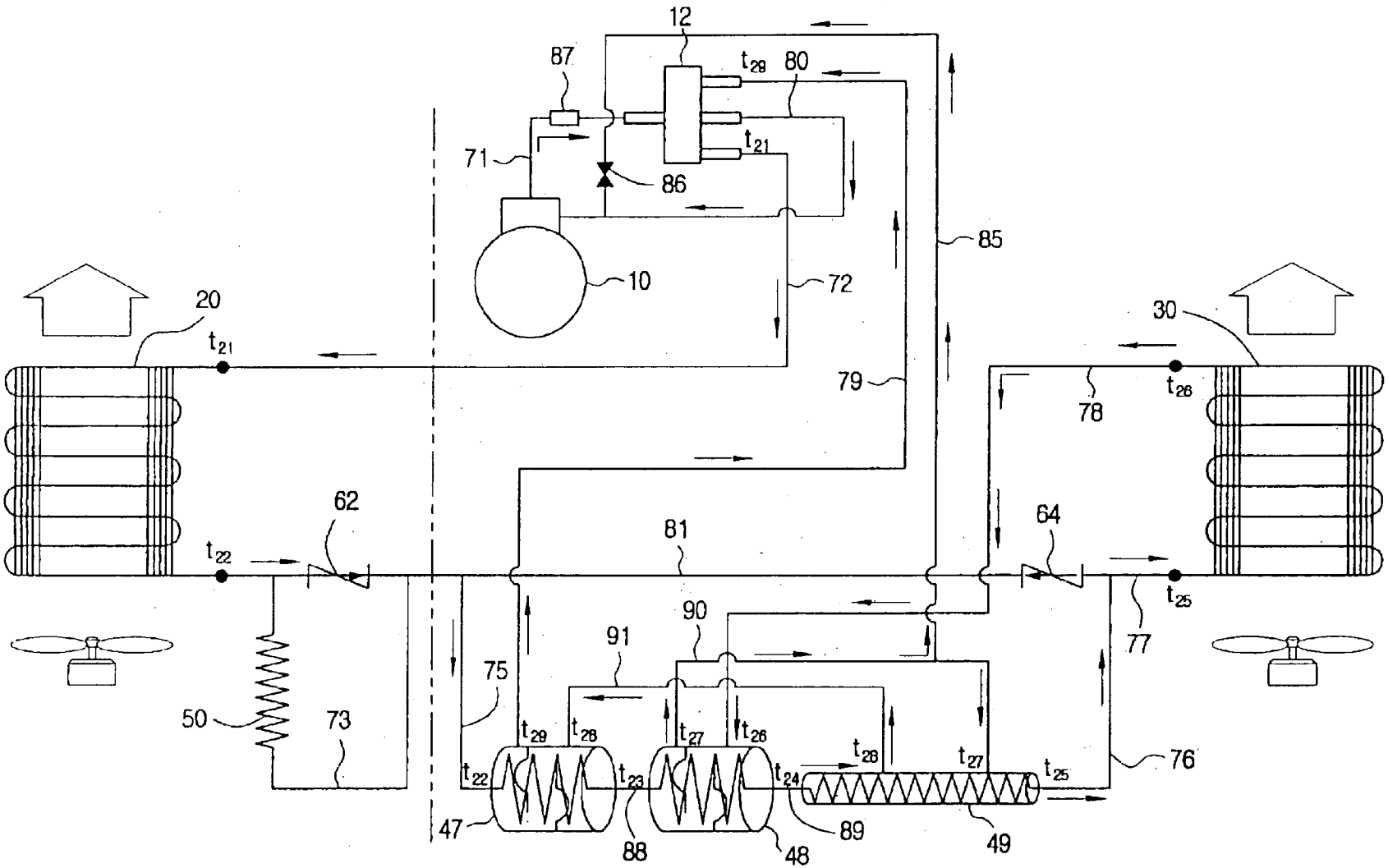
Figure 9B:
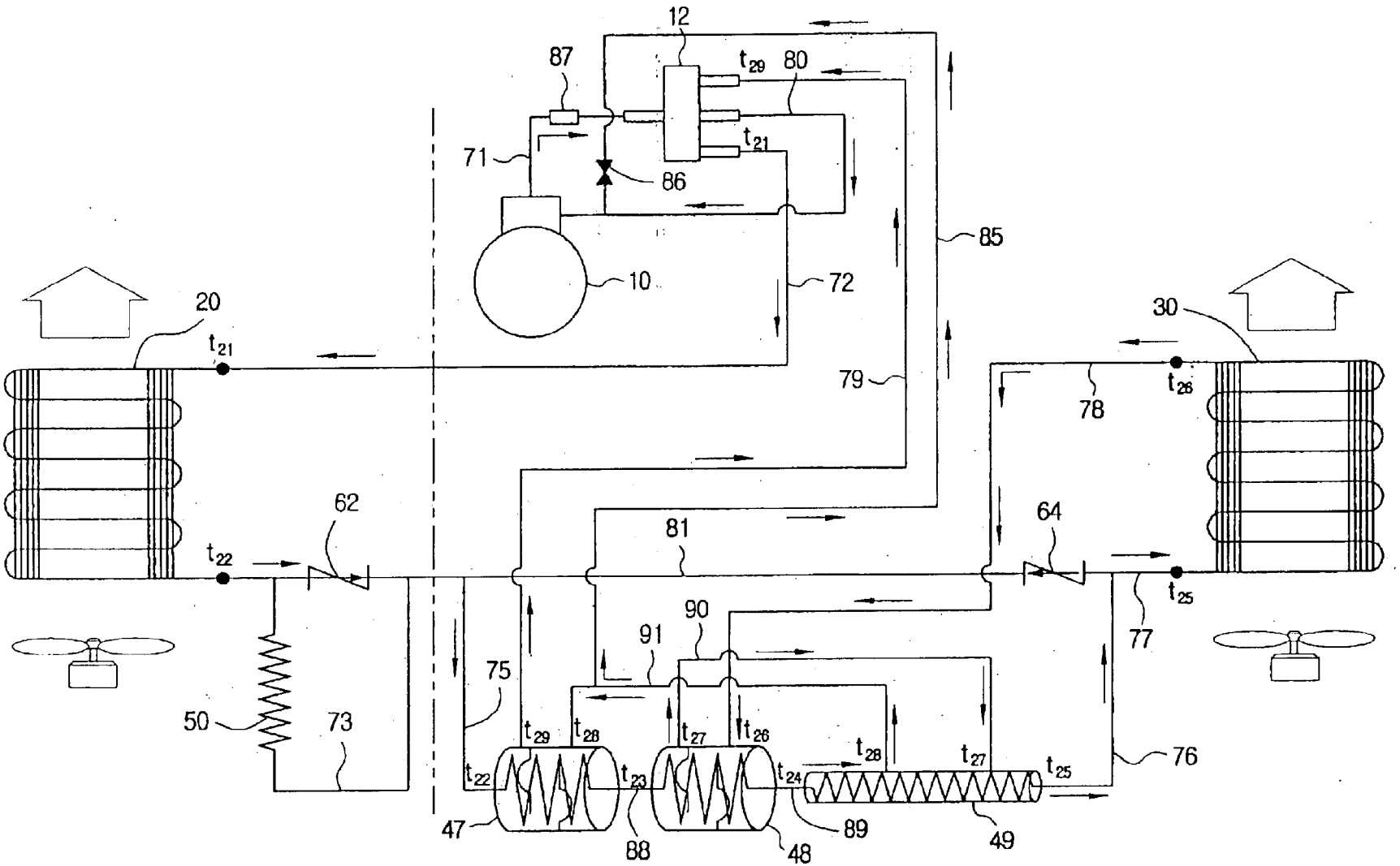

As shown in FIGS. 9*a* and 9*b*, the second refrigerant supply line 85 is installed between the outdoor unit 30 and the expansion unit 49 for supplying a low temperature refrigerant to the compressor 10 or is installed between the expansion unit 49 and the second heat exchanger 48 or is installed between the second heat exchanger 48 and the first heat exchanger 47. It is possible to selectively use a low temperature refrigerant based on a temperature of refrigerant supplied to the compressor checked by the temperature sensor 87. Namely, in the case that the temperature of the refrigerant checked by the temperature sensor 85 is in a high temperature range, the refrigerant from the outdoor unit 30 is mixed, and in the case that the temperature of the checked refrigerant is in an intermediate temperature range, the refrigerant from the expansion unit 49 is mixed. In the case that the temperature of the checked refrigerant is in a low temperature range, the refrigerant from the second heat exchanger 48 is mixed.

As described above, in the combined regeneration cooling and heating system according to the present invention, a heat exchanger capable of heating-exchanging a high temperature refrigerant from the indoor unit in the heating mode and a low temperature refrigerant from the outdoor unit, and an expansion unit capable of expanding the refrigerant from the heat exchanger are installed in the interior of one heat exchange unit, so that it is possible to implement a high heat exchange efficiency based on a heat exchange between a high temperature refrigerant flowing in the interior of the expansion unit and a low temperature refrigerant flowing in the outside.

In addition, in the present invention, it is possible to simplify the constructions of the facilities of the heat exchange system by providing the heat exchanger and the expansion unit in one heat exchange unit and by concurrently performing the heat exchange and expansion operations.

Furthermore, in the present invention, it is possible to prevent a frost formation in an outdoor unit in such a manner that the refrigerant supplied to the outdoor unit is heat-exchanged with the refrigerant discharged from the outdoor unit, so that a temperature difference with respect to the outdoor temperature is below a frost formation temperature.

In the present invention, it is possible to implement an efficient operation of compressor in such a manner that a low temperature refrigerant that is not heat-exchanged is mixed with a high temperature refrigerant heat-exchanged by the heat exchanger in the heating mode for thereby increasing a low temperature refrigerant flowing into the compressor.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

The present disclosure relates to subject matter contained in Korean Patent Application Nos. 2002-73656, filed on Nov. 25, 2002, and 2003-67369, filed on Sep. 26, 2003, the contents of both being expressly incorporated by reference in their entireties.

What is claimed is:

1. In a cooling and heating system including a compressor for compressing refrigerant to a high temperature and pressure state, an indoor unit installed in the indoor for cooling an indoor air by heat-exchanging a low temperature expanded refrigerant with an indoor air in the cooling mode and for heating an indoor air by heat exchanging a high temperature and pressure refrigerant with an indoor air in the heating mode, an outdoor unit installed in the outdoor for discharging heat into the air by heat-exchanging a high temperature and pressure refrigerant with an external air in the cooling mode and for heating a refrigerant by heat-exchanging the expanded refrigerant with an external air in the heating mode, and a heat exchange unit for heat-exchanging a high temperature refrigerant from the indoor unit with a low temperature refrigerant from the outdoor unit in the heating mode, a combined regeneration cooling and heating system that is characterized in that a heat exchanger capable of heat-exchanging a high temperature refrigerant from the indoor unit with a refrigerant inputted into the outdoor unit, and an expansion unit adapted to receive a refrigerant of the heat exchanger and to expand for cooling the refrigerant are installed in the interior of the heat exchange unit; and a high temperature refrigerant from the indoor unit and a low temperature refrigerant from the outdoor unit are inputted into the heat exchange unit in the heating mode; and the high temperature refrigerant flows through the heat exchanger and the expansion unit and is heat-exchanged with the low temperature refrigerant.

2. The system of claim 1, wherein said heat exchanger is a heat exchanger of a double capillary tube method.

3. The system of claim 1, wherein more than at least one heat exchanger is installed between the heat exchange unit and the outdoor unit so that a refrigerant expanded by the expansion unit and a refrigerant discharged from the outdoor unit are heat-exchanged in the heating mode.

4. The system of claim 1, wherein more than at least one movement prevention protrusion (turbulence generation panel) is formed in the interior of the heat exchange unit so that a refrigerant from the outdoor unit is properly heat-exchanged.

5. The system of claim 1, further comprising a first refrigerant supply line between the indoor unit and the heat exchange unit for directly supplying a high temperature refrigerant from the indoor unit to the outdoor unit and for controlling the same.

6. The system of claim 1, further comprising:

a temperature sensor for checking a temperature of refrigerant from the compressor and comparing whether the temperature of the refrigerant checked is an over-compressed refrigerant temperature or not;

a second refrigerant supply line for directly supplying a low temperature refrigerant from the outdoor unit to the compressor in accordance with a signal of the temperature sensor in the case that the checked temperature is an over compressed refrigerant temperature; and a refrigerant adjusting valve for controlling the amount of the refrigerant inputted into the refrigerant supply line.

7. The system of claim 1, wherein in said heat exchange unit, a first heat exchanger, a second heat exchanger and an expansion unit are sequentially installed, and a high temperature refrigerant from the indoor unit is inputted into the outdoor unit sequentially through the first heat exchanger, the second heat exchanger and the expansion unit in the heating mode, and a low temperature refrigerant from the outdoor unit is sequentially inputted into the second heat exchanger, the first expansion unit and the first heat exchanger, so that the high temperature refrigerant and the low temperature refrigerant are heat-exchanged.

8. The system of claim 7, wherein a first refrigerant supply line is installed between the expansion unit and the second heat exchanger for directly supplying a high temperature refrigerant, passed through the expansion unit, to the compressor.

9. The system of claim 7, wherein a first refrigerant supply line is installed between the second heat exchanger and the first heat exchanger for directly supplying a high temperature refrigerant, passed through the second heat exchanger, to the compressor.

* * * * *

UNITED STATES PATENT AND TRADEMARK OFFICE

CERTIFICATE OF CORRECTION

PATENT NO. : 6,865,904 B2
APPLICATION NO. : 10/720108
DATED : March 15, 2005
INVENTOR(S) : Hwa-Sik Wang It is certified that error appears in the above-identified patent and that said Letters Patent is hereby corrected as shown below:

On Title Page Item (30), Foreign Application Priority Data: line 2, reads "Sep. 26, 2003" should read -- Sep. 29, 2003 --
Column 9, line 22, reads "heat exchanging" should read -- heat-exchanging --
Column 9, line 42, reads "heating mode;" should read -- heating mode, --

Signed and Sealed this

Sixth Day of March, 2007

JON W. DUDAS
*Director of the United States Patent and Trademark Office*